US006708732B1

(12) United States Patent
Hay et al.

(10) Patent No.: US 6,708,732 B1
(45) Date of Patent: Mar. 23, 2004

(54) FABRICS FOR WEB FORMING EQUIPMENT

(75) Inventors: Stewart Lister Hay, Bury (GB); Jeffrey Bruce Herman, Bala Cynwyd, PA (US)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 139 days.

(21) Appl. No.: 10/112,505

(22) Filed: Mar. 28, 2002

(51) Int. Cl.[7] ..... D21F 1/10

(52) U.S. Cl. ..... 139/383 A; 139/383 R; 162/902

(58) Field of Search ..... 139/383 R, 383 A; 162/902, 361, 348

(56) References Cited

U.S. PATENT DOCUMENTS

| | | | | | |
|---|---|---|---|---|---|
| 4,989,647 | A | * | 2/1991 | Marchand | 139/383 A |
| 4,995,428 | A | * | 2/1991 | Tate et al. | 139/383 A |
| 5,025,839 | A | * | 6/1991 | Wright | 139/383 A |
| 5,421,375 | A | * | 6/1995 | Praetzel | 139/383 A |
| 5,429,686 | A | | 7/1995 | Chiu et al. | |
| 5,609,931 | A | * | 3/1997 | Delavallade | 428/36.1 |
| 5,713,397 | A | * | 2/1998 | Quigley | 139/383 A |
| 6,000,440 | A | * | 12/1999 | Hay | 139/383 A |
| 6,203,663 | B1 | | 3/2001 | Kamps et al. | |
| 6,227,256 | B1 | * | 5/2001 | Quigley | 139/383 A |
| 6,237,644 | B1 | | 5/2001 | Hay et al. | |
| 6,340,413 | B1 | * | 1/2002 | Nilsson et al. | 162/361 |
| 6,379,506 | B1 | * | 4/2002 | Wilson et al. | 162/348 |
| 6,413,377 | B1 | * | 7/2002 | Wright | 139/383 A |

FOREIGN PATENT DOCUMENTS

| | | |
|---|---|---|
| SE | 427053 | 6/1983 |

* cited by examiner

*Primary Examiner*—John J. Calvert
*Assistant Examiner*—Robert H. Muromoto, Jr.
(74) *Attorney, Agent, or Firm*—Caesar, Rivise, Bernstein, Cohen & Pokotilow, Ltd.

(57) ABSTRACT

A web forming fabric has a machine direction of intended movement on a web forming machine and a cross-machine direction substantially normal to the machine direction. The fabric includes machine direction yarns disposed generally in the machine direction and transverse yarns disposed generally transversely to the machine direction. The fabric includes first and second substantially linear arrays of systematically distributed areas of high drainage on one side thereof. These linear arrays are oriented at an acute angle to the machine direction and at an acute angle to each other. The boundaries of each of the systematically distributed areas are defined by two pairs of adjacent sides; the adjacent sides of one pair being angled segments of one transversely extending yarn and the adjacent sides of the other pair being angled segments of a second transversely extending yarn contiguous to the one transversely extending yarn. The opposite side of the fabric has long machine direction floats over adjacent transverse yarns and the machine direction floats of adjacent machine direction yams partially overlap each other in the machine direction.

20 Claims, 9 Drawing Sheets

10

11k

111a

100

FABRICS FOR WEB FORMING EQUIPMENT

FIELD OF THE INVENTION

This invention relates to unique fabrics for use in web forming machines for making sanitary paper webs (e.g., tissue and towel stock) and other wet formed cellulosic sheets or nonwoven webs; most desirably patterned web products which are especially suitable for use in papermaking machines. Although the fabrics of this invention are particularly well suited for use as a forming wire in the forming section of a papermaking machine to make patterned sanitary paper products, it is within the scope of the broadest aspects of this invention to employ these fabrics for a variety of other applications in papermaking machine, e.g., as a transfer fabric or dryer fabric, particularly a through-air-dryer (TAD) fabric, as well as in nonwoven apparatus. For some applications one surface of the fabric is employed as the web-contacting, or engaging surface, whereas for other applications the opposed surface of the fabric may preferably be employed as the web-contacting, or engaging surface.

Reference throughout this application to a "web forming machine" includes both papermaking and nonwoven machines.

Reference throughout this application to a "web forming fabric" is not limited to use of the fabric in the forming section of a web forming machine, but includes uses in other areas of such web forming machines.

BACKGROUND OF THE INVENTION

Web forming fabrics employed to make patterned fibrous webs are commercially available and a number of such fabrics are disclosed in existing patents, e.g., U.S. Pat. No. 6,237,644 (Hay et al.), U.S. Pat. No. 5,429,686 (Chiu), U.S. Pat. No. 6,203,663 (Chiu) and Swedish Patent No. 427,053 (Gusums Bruk AB). It is important that these fabrics be capable of use in forming fibrous webs having a desired balance of strength, caliper and absorbency (including absorbency capacity and rate).

The inventors herein are two of the four inventors of the inventions forming the subject matter of Hay et al. U.S. Pat. No. 6,237,644. This latter patent discloses tissue forming fabrics, particularly single layer structures, employed to form fibrous webs having a useful combination of strength, caliper and absorbency.

There is a continuing desire to provide fabric constructions capable of use to form fibrous webs having enhanced, or increased, strength, caliper, absorbent capacity and/or absorbency rate. In particular, there is a continuing need to achieve a desired balance among these various properties. Generally, just improving the strength of the formed web tends to result in a denser structure that often does not provide the desired absorbency rate and/or capacity required in tissue products.

There also is a benefit and desire for web forming fabrics having opposed surfaces, each of which can constitute a web-engaging surface, depending upon the specific application of the forming fabric in the web forming machine.

Thus, a continuing need exists for web forming fabrics capable of use in forming fibrous webs, e.g., tissue products, having a desired balance of strength, caliper, absorbency rate and capacity, and that also is versatile in use.

SUMMARY OF THE INVENTION

The above and other objects of this invention are achieved in a web forming fabric having a machine direction of intended movement on a web forming machine and a cross-machine direction substantially normal to said machine direction, wherein said fabric includes machine direction yarns disposed generally in the machine direction and transverse yarns disposed generally transversely to the machine direction, said fabric including on one surface thereof first and second substantially linear arrays of systematically distributed areas of high drainage, said first and second substantially linear arrays being oriented at an acute angle to the machine direction and at an acute angle to each other. The boundaries of each of said systematically distributed areas are defined by two pairs of adjacent sides, the adjacent sides of one pair being angled segments of one transversely extending yarn and the adjacent sides of the other pair being angled segments of a second transversely extending yam contiguous to said one transversely extending yarn.

In preferred embodiments of this invention the systematically distributed areas of high drainage in the web forming fabrics of this invention include within their boundaries only machine direction yarns.

In accordance with the preferred embodiments of a web forming fabric of this invention, each systematically distributed area in the first substantially linear array is separated from contiguous systematically distributed areas on opposite sides thereof and in the same substantially linear array by spaced-apart angled segments of a pair of single transverse yarns that are contiguous to each other.

In one preferred embodiment of this invention the systematically distributed areas in the first substantially linear array are separated from adjacent systematically distributed areas in the same first substantially linear array by an angled segment of a single transverse yarn, and the systematically distributed areas in the second substantially linear array are separated from adjacent systematically distributed areas in the same second substantially linear array by an angled segment of a single transverse yarn.

In another embodiment of this invention, the systematically distributed areas in the first substantially linear array are separated from adjacent systematically distributed areas in the same first substantially linear array by an angled segment of a single transverse yarn and the systematically distributed areas in the second substantially linear array are separated from adjacent systematically distributed areas in the same second substantially linear array by a plurality of contiguous angled segments of contiguous transverse yarns, said contiguous angled segments of contiguous transverse yarns providing areas of drainage lower than that of the systematically distributed areas.

In accordance with the preferred embodiments of this invention the machine direction yarns on the side of the fabric opposed to the side including the systematically distributed surface areas, each include relatively long floats over a plurality of adjacent weft yarns; preferably over at least six adjacent weft yarns. Most preferably, each of the continuous machine direction floats of each machine direction yarn floats over at least the same three contiguous weft yarns as an adjacent machine direction yarn, with the continuous machine direction floats of adjacent machine direction yarns partially overlapping each other in the machine direction.

In one embodiment, each relatively long machine direction float is over seven adjacent weft yarns, with each continuous machine direction float of each machine direction yarn being over at least the same four contiguous weft yarns as an adjacent machine direction yarn and with the continuous machine direction floats of adjacent machine direction yarns partially overlapping each other in the machine direction.

The side of the fabric opposed to the side including the systematically distributed surface areas is well suited for engaging, or contacting the web being dryed in a dryer section of a web forming machine; preferably in a through-air-dryer section of a papermaking machine. In particular, the long, partially overlapping machine direction floats of adjacent machine direction yarns establish excellent adherence of the web to a creping cylinder (e.g., a Yankee dryer) in the machine direction to provide for very effective creping of the web being formed.

DETAILED DESCRIPTION OF THE PREFERRED EMBODIMENTS

Figure 3:
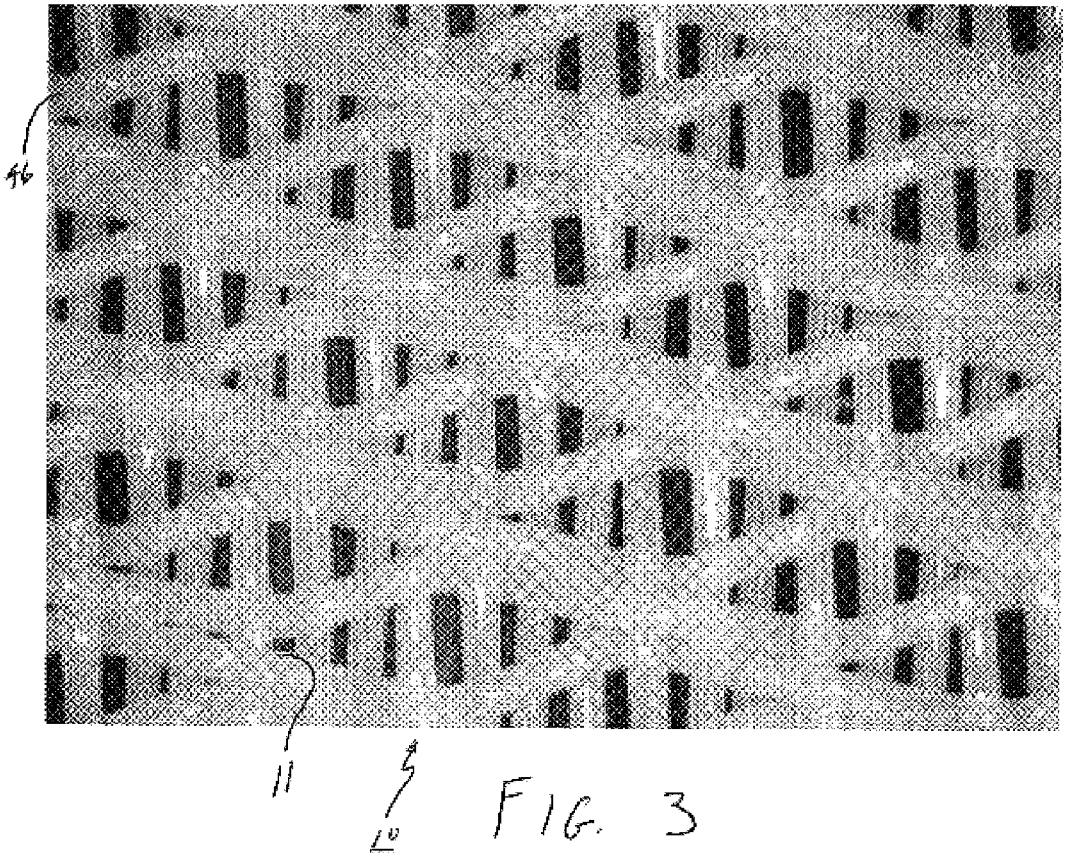
FIG. 3 is a photograph of the surface of the web forming fabric illustrated in FIG. 1.
Figure 4:
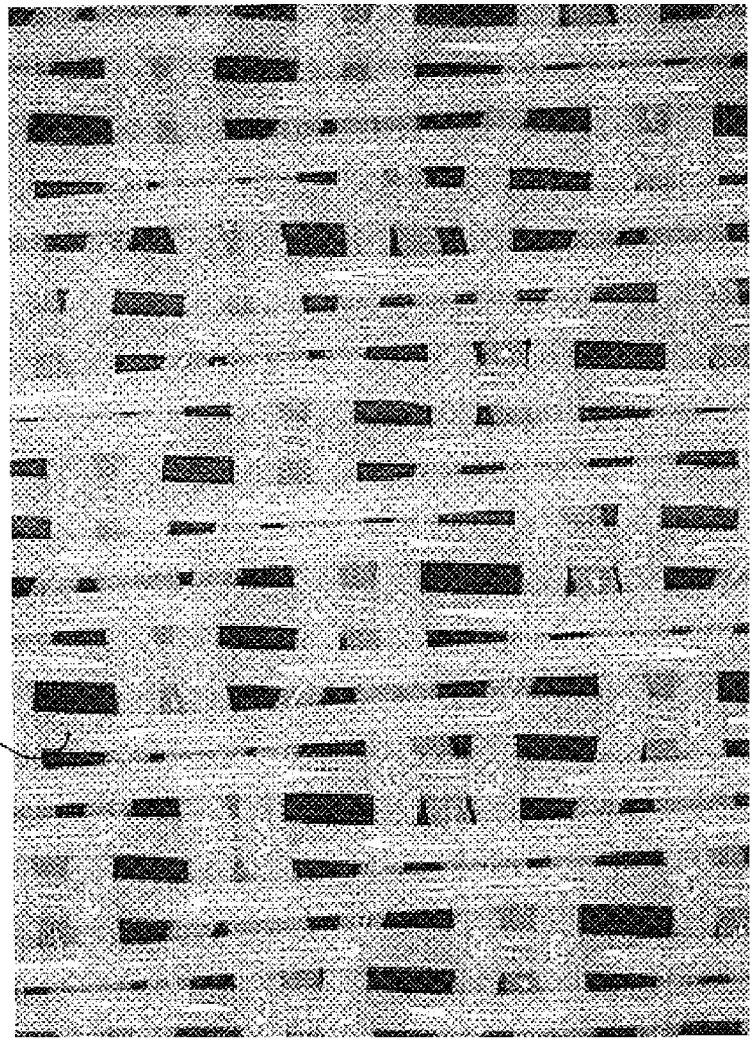
FIG. 4 is a photograph of the surface of the web forming fabric illustrated in FIG. 2.
Figure 5:
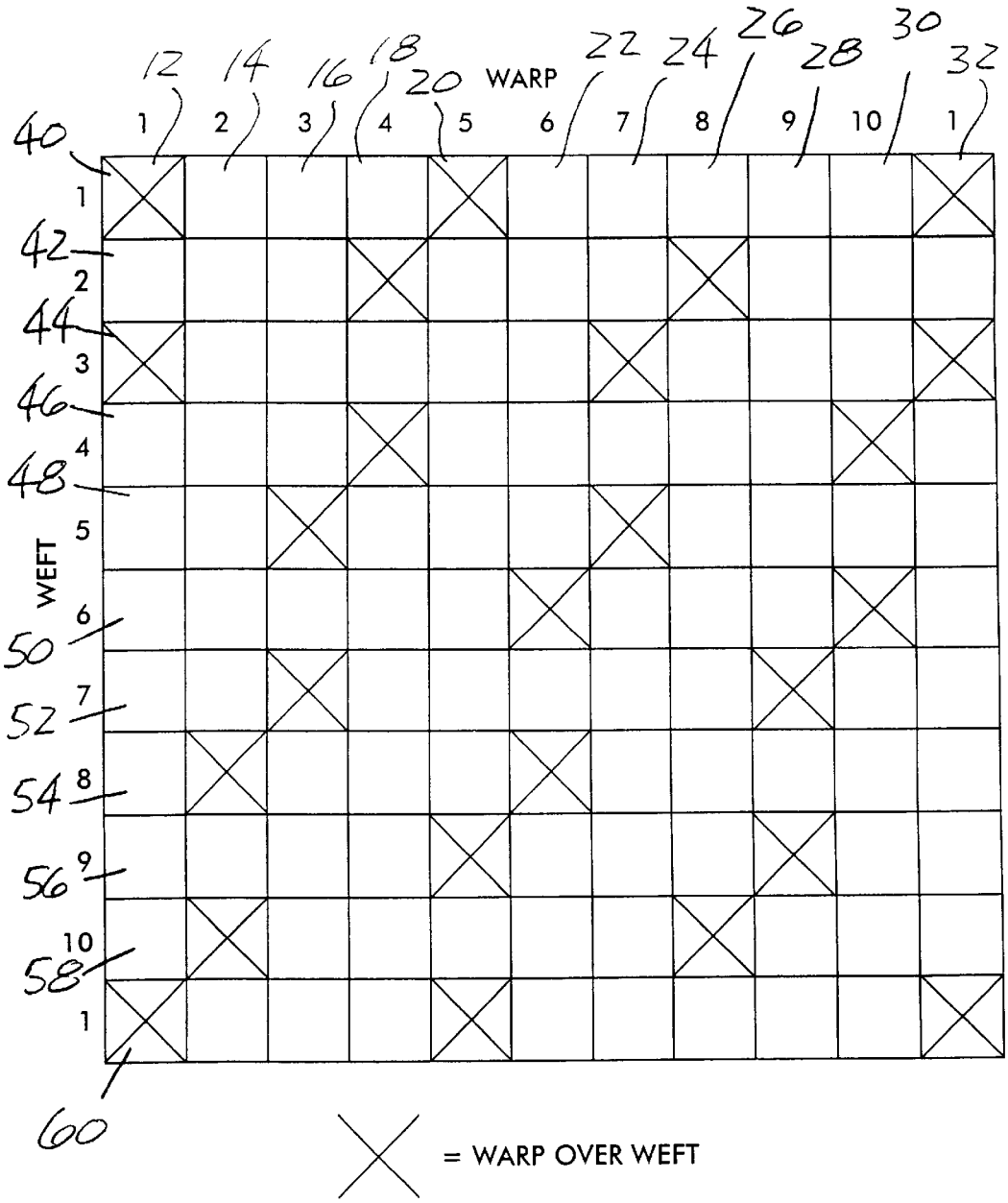
FIG. 5 is a weave diagram of the fabric illustrated in FIGS. 1 through 4, with the X's illustrating regions in which the machine direction yarns pass over the transverse direction yarns on the surface of the fabric illustrated in FIGS. 1 and 3.

Referring to the drawings, a web forming fabric in accordance with one embodiment of the invention is shown generally at 10 in FIGS. 1–4, and the weave diagram for the fabric is shown in FIG. 5. This fabric includes a 10 shaft repeat and a 10 step repeat. However, the weave pattern can be varied, so long as the structure described hereinafter is achieved.

Figure 1:
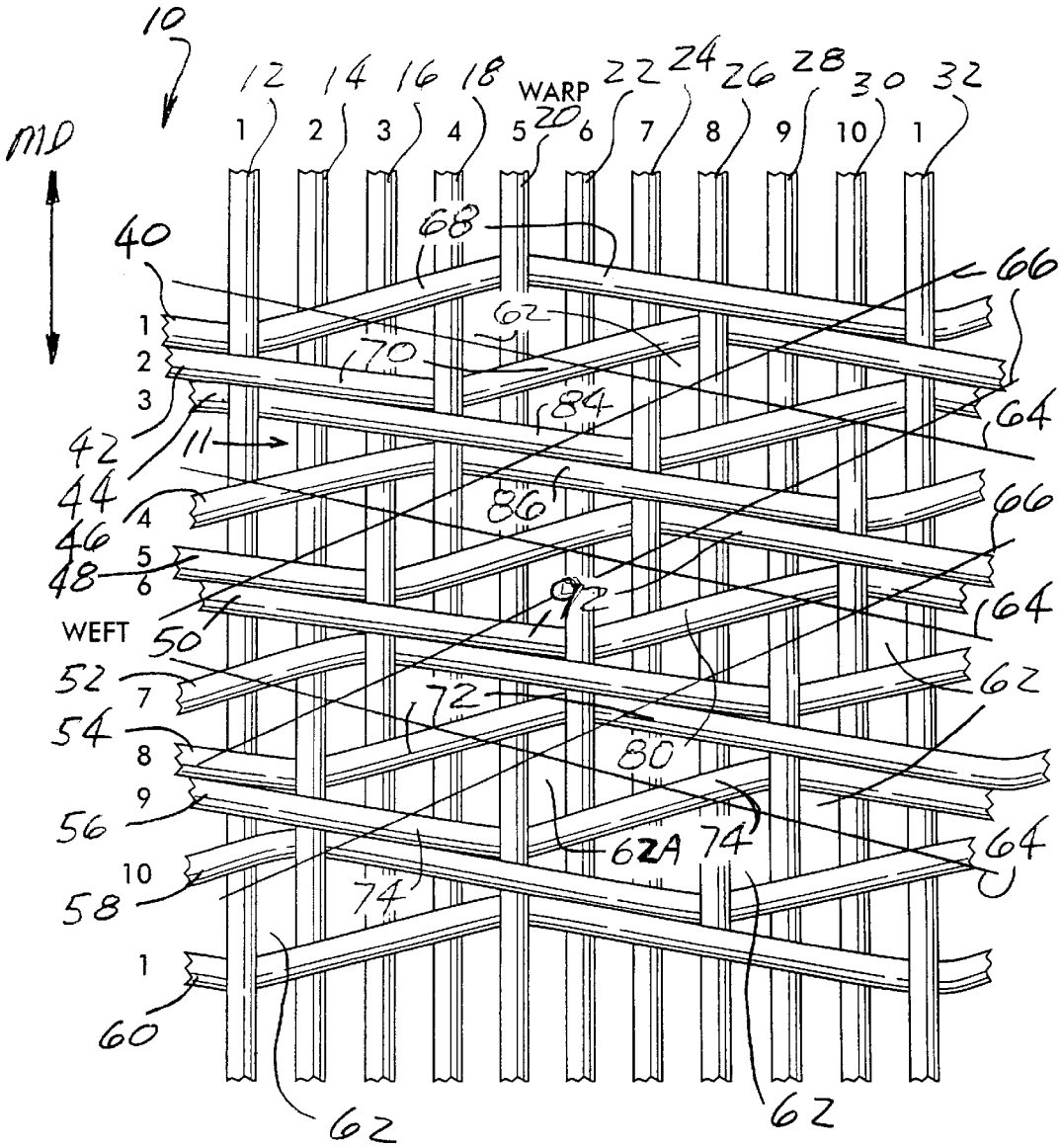
FIG. 1 is a view from one side of a web forming fabric in accordance with one embodiment of the invention.

Turning to FIGS. 1 and 3, a web-engaging surface or side 11 of the fabric 10 is illustrated. When the fabric 10 is employed in the web forming zone of a papermaking machine, the side 11 of the fabric 10 receives the papermaking slurry thereon, with the water being drained through the fabric by gravity, pressure or vacuum assist.

The difference between the illustration in FIG. 1 and the photograph in FIG. 3 is that the weft, or transverse yarn pattern is shifted by three yarns. That is, the fourth weft yarn from the top depicted in FIG. 1 (46) is the first full weft yarn from the top depicted in the photograph of FIG. 3.

It should be understood that when the fabric 10 is flat woven, which is usually the method employed in the formation of forming fabrics for use in the forming zone of a web forming machine, the warp yarns are the machine-direction yarns, which are oriented in the machine-direction of movement of the fabric on the web forming machine, and the weft yarns are the cross-machine-direction yarns, which are oriented in the transverse direction to the direction of movement of the fabric on the web forming machine.

In a tubular weaving operation, which often is employed to form woven fabrics utilized in dryer fabrics, the weft yarns are the machine-direction yarns, which are oriented in the machine-direction of movement of the fabric on the web forming machine, and the warp yarns are the cross-machine-direction yarns, which are oriented in the transverse direction to the direction of movement of the fabric on the web forming machine.

For purposes of brevity, the description which follows is directed to flat woven fabrics of the invention, it being understood that in tubular woven fabrics the machine direction yarns will be weft yarns and the cross machine direction yarns will be warp yarns.

Referring to FIG. 5, the weave diagram, which depicts by X's warp yarns passing over weft yarns on the surface 11 of the fabric, illustrates certain interesting features of the fabric 10 of this invention. First, in each repeat pattern each of the ten (10) warp yarns passes over less than half of the ten (10) weft yarns, and in the preferred embodiment passes over only two (2) of the ten (10) weft yarns. This results in the formation of a single layer fabric that generally has identifiable sub-levels in the surface 11 of the fabric 10, with the bottom level, as viewed from the surface 11 (FIGS. 1 and 3), being generally defined solely by machine-direction warp yarns.

Moreover, as will be described in greater detail later in this application in connection with FIG. 2, the preferred weave pattern of the fabric 10 results in each machine direction yarn having relatively long machine direction floats on the side of the fabric 11*a* opposed to side 11, with the machine direction floats of adjacent machine direction yarns in this surface 11*a* partially overlapping each other in the machine direction. This arrangement makes the side 11*a* of the fabric 10 well-suited for use in the dryer section of a web forming machine, and in particular in a through-air dryer (TAD) section of a papermaking machine, as will be described in greater detail hereinafter.

Referring to FIGS. 1 and 3, the web forming fabric 10 employs a 10 shaft/10 step repeat pattern with the warp yarns 12, 14, 16, 18, 20, 22, 24, 26, 28, 30 and 32 being in the machine direction of intended movement on a web forming machine and the weft yarns 40, 42, 44, 46, 48, 50, 52, 54, 56, 58, 60 being oriented generally in the cross-machine direction. It should be understood that the warp yarn 32 is in the identical orientation relative to the weft yarns as warp yarn 12, and actually starts a second repeat. Likewise, the weft yarn 60 is in the identical orientation relative to the warp yarns as weft yarn 40, and also starts a second repeat.

Referring to FIGS. 1 and 3, the fabric 10, as viewed from the side 11 includes systematically distributed, high drainage areas 62 arranged in first and second substantially linear arrays, with each drainage area being located in each of said substantially linear arrays.

Referring to FIGS. 1 and 3, the first substantially linear arrays of high drainage areas 62 are depicted by the reference lines 64, which pass generally through the centers thereof, and the second substantially linear arrays of high drainage areas 62 are depicted by the reference lines 66, which pass generally through the centers thereof. As should be apparent from a study of the drawings, the first and second substantially linear arrays of high drainage areas are oriented at an acute angle to the machine direction (MD) and at an acute angle to each other.

The boundaries of each of said systematically distributed high drainage areas 62 are defined by two pairs of adjacent sides, e.g., 68—68 and 70—70, respectively. The adjacent sides 68—68 are angled segments of one transversely extending weft yarn, e.g., 40, and the adjacent sides 70—70 are angled segments of a second transversely extending weft yarn ,e.g., 42, contiguous to said one transversely extending weft yarn 40. This relationship exists for all of the systematically distributed areas 62, e.g., the systematically distributed area designated 62*a* (which is the same as the other systematically distributed areas 62 but is designated 62*a* for purposes of this discussion) is defined by two pairs of adjacent sides 72—72 and 74—74, respectively; with the adjacent sides 72 being angled segments of weft yarn 54 and the adjacent sides 74 being angled segments of contiguous weft yarn 56.

Still referring to FIGS. 1 and 3, the region within the boundaries of each of the systematically distributed areas 62 is provided solely by machine direction yarns, e.g., machine direction yarns 16, 18, 20, 22, 24 and 26 are the only yarns provided within the boundaries of the systematically distributed area designated 62*a*.

Still referring to FIGS. 1 and 3, each of the systematically distributed areas 62 in each of the first substantially linear arrays defined by the reference lines 64 are separated from adjacent systematically distributed areas 62 in the same first substantially linear array by an angled segment, e.g., 80 of a single transverse yarn, e.g., 50 and the systematically distributed areas 62 in each of the second substantially linear arrays defined by the reference lines 66 are separated from adjacent systematically distributed areas 62 in the same second substantially linear array by a plurality of contiguous angled segments, e.g., 84, 86 of contiguous transverse yarns, e.g., 44, 46. However, as can be seen in FIGS. 1 and 3, the sides defining the opposite boundaries of each of the systematically distributed areas 62 are provided by angled segments, e.g., 92 of a pair of single transverse weft yarns that are contiguous to each other, e.g., 48, 50.

Still referring to FIGS. 1 and 3, contiguous transverse, weft yarns also include contiguous angled segments that are aligned generally along a line intermediate adjacent reference lines 64 and provide spaced-apart areas of drainage that are significantly lower than in the systematically distributed areas 62. These spaced apart areas of low drainage are created by heavy twill lines (e.g., illustrated by adjacent segments 70,84; 84,86; 86,92), each extending continuously at an acute angle relative to the machine direction, from one side edge of the fabric 10 to the other.

The fibrous webs formed on the fabric 10, when the fabric is employed in the forming section of a papermaking machine, tend to have low basis weight regions formed in these low drainage areas of the fabric, resulting in an adverse effect on the tensile strength of the fabric. However, for some applications the strength level may be acceptable; particularly in view of enhanced caliper and absorbency characteristics obtained in the formed web by use of the web forming fabric 10 of this invention. For example, it is possible that the fabric 10 may be acceptable either by itself, or as part of a multiply structure, e.g., multiply board structures.

Figure 2:
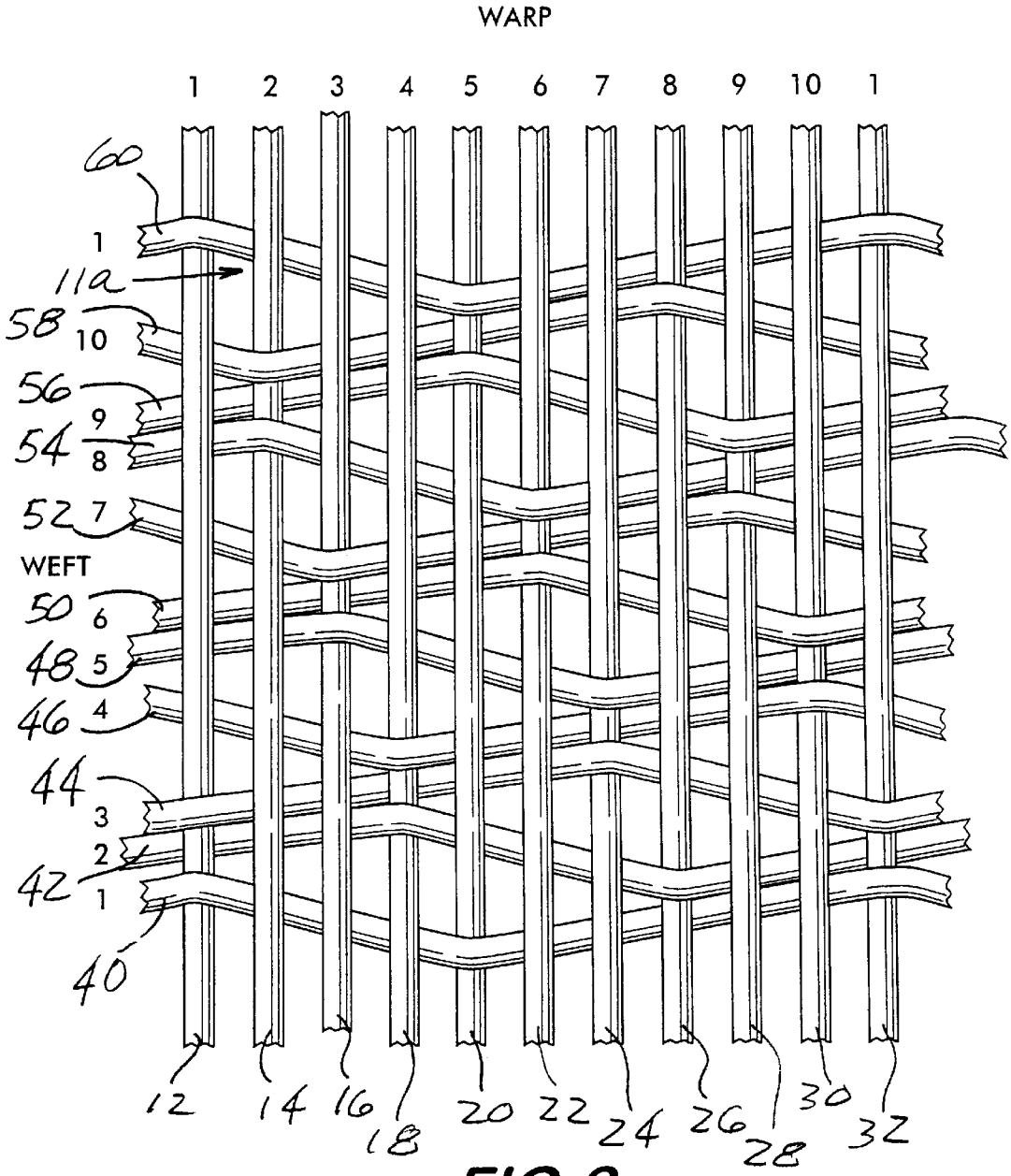
FIG. 2 is a view of the surface of the web forming fabric opposite the surface shown in FIG. 1.

FIGS. 2 and 4 illustrate the appearance of the fabric 10 as viewed from side 11*a* of the fabric, which is opposed to the side 11. The weave pattern also can be understood by referring to FIG. 5, which illustrates, by clear, or blank, squares, the regions in which the machine direction yarns float over the weft yarns on the side 11*a* of the fabric. This side 11*a* is believed to be well suited for use as a web-contacting or web-engaging surface in dryer applications, and more preferably in through air dryer applications. In particular, the long machine direction floats provided by each machine direction yarn, accompanied by the fact that adjacent machine direction floats partially overlap in the machine direction, should provide excellent adherence of the web being formed to a Yankee dryer or other creping cylinder in the circumferential direction of creping from the dryer or cylinder.

Referring to FIGS. 2, 4 and the weave diagram of FIG. 5, it should be noted that in side 11*a* each of the machine direction yarns floats over seven contiguous weft yarns in each repeat, e.g., warp yarn 12 floats continuously over weft yarns 46, 48, 50, 52, 54, 56 and 58; warp yarn 14 floats continuously over weft yarns 40, 42, 44, 46, 48, 50 and 52, etc. Moreover, each of the machine direction yarns in the side 11*a* floats continuously over four of the same weft yarns as each adjacent machine direction yarn, e.g., both machine direction yarns 12 and 14 float continuously over weft yarns 46, 48, 50 and 52; both machine direction yarns 14 and 16 float continuously over weft yarns 40, 42, 44 and 46, etc. Thus each continuous float of each machine direction yarn in the side 11*a* partially overlaps in the machine direction with a continuous float of an adjacent machine direction yarn over a distance equal to the four contiguous weft yarns over which each of said adjacent yarns floats.

Figure 8:
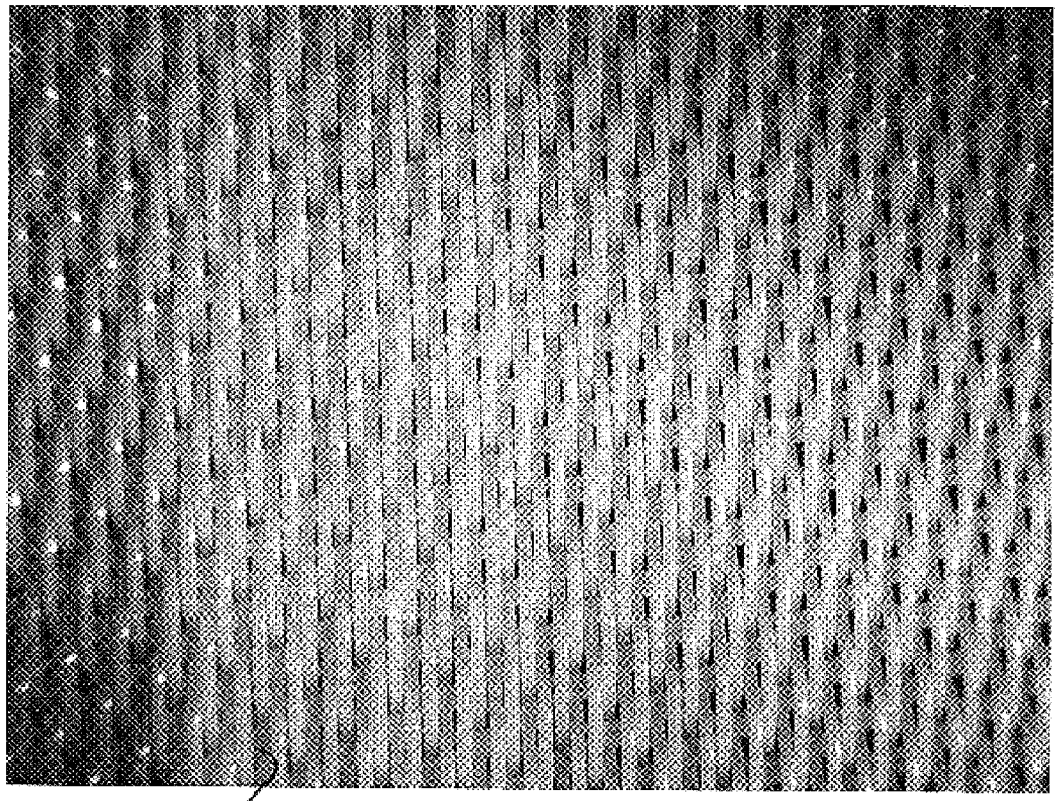
FIG. 8 is a photograph of the surface of the web forming fabric opposite the surface shown in FIGS. 6 and 7.
Figure 9:
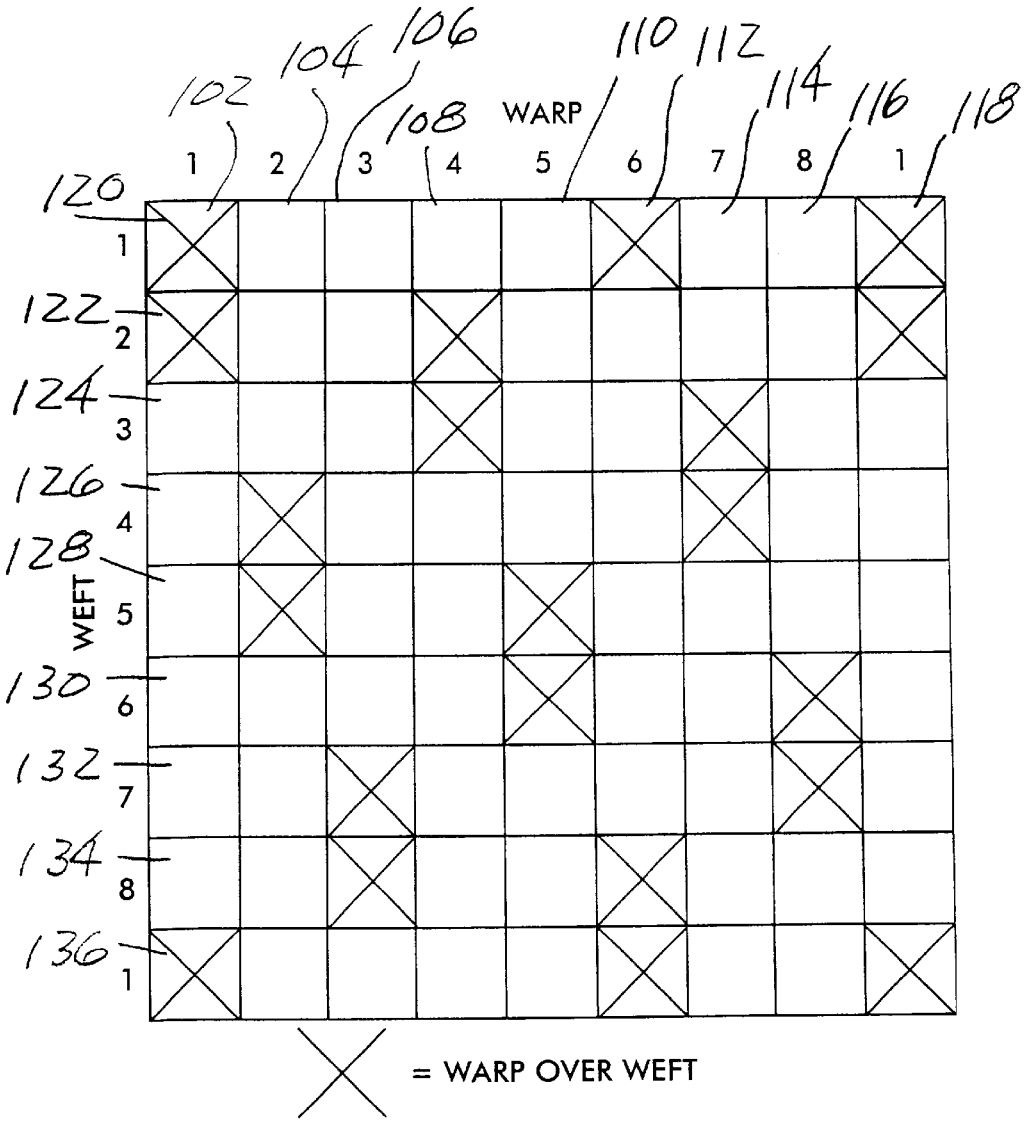
FIG. 9 is a weave diagram of the fabric illustrated in FIGS. 6 through 8, with the X's illustrating regions in which the machine direction yarns pass over the transverse direction yarns on the surface illustrated in FIGS. 6 and 7.

Referring to FIG. 9, a weave diagram of an alternate web forming fabric 100 (FIGS. 6–8) in accordance with this invention is shown. In fact, this is believed to be a more preferred embodiment than the web forming fabric 10, because it does not provide the same heavy twill lines that are created in the fabric 10. Thus, fibrous webs formed on the web forming fabric 100 may not have the same undesired lines of low basis weight that result from the formation of fibrous webs on the fabric 10. By reducing, or minimizing, these low basis weight lines, the tensile strength of the formed webs should be enhanced.

The weave pattern shown in FIG. 9, although having an 8 shaft/8 step repeat pattern, does have similar features to the weave pattern of the web forming fabric 10. In particular, in each repeat, each of the machine direction warp yarns 102, 104, 106, 108, 110, 112, 114, 116 and 118 on one side 111 of the fabric passes over less than half of the weft yarns 120, 122, 124, 126, 128, 130, 132, 134 and 136, and preferably passes over only two of the weft yarns in the repeat. This same feature exists on side 11 of the web forming fabric 10. However, unlike the weave pattern in the web forming fabric 10, each of the machine direction warp yarns passes over two adjacent transverse weft yarns on side 111, e.g., warp yarn 102 passes over adjacent weft yarns 120 and 122; warp yarn 104 passes over adjacent weft yarns 126 and 128, etc. In the web forming fabric 10 each of the machine direction warp yarns, on side 11, passes over transverse weft yarns that are spaced from each other by one additional transverse weft yarn, e.g., warp yarn 12 passes over weft yarns 40 and 44, but under 42; warp yarn 14 passes over weft yarns 54 and 58, but under 56, etc.

It should be noted that the warp yarns 102 and 118 have the same position and orientation with respect to all of the weft yarns because warp yarn 118 starts a new repeat. Likewise, the weft yarns 120 and 136 have the same position and orientation with respect to all of the warp yarns because the weft yarn 136 starts a new repeat.

Figure 6:
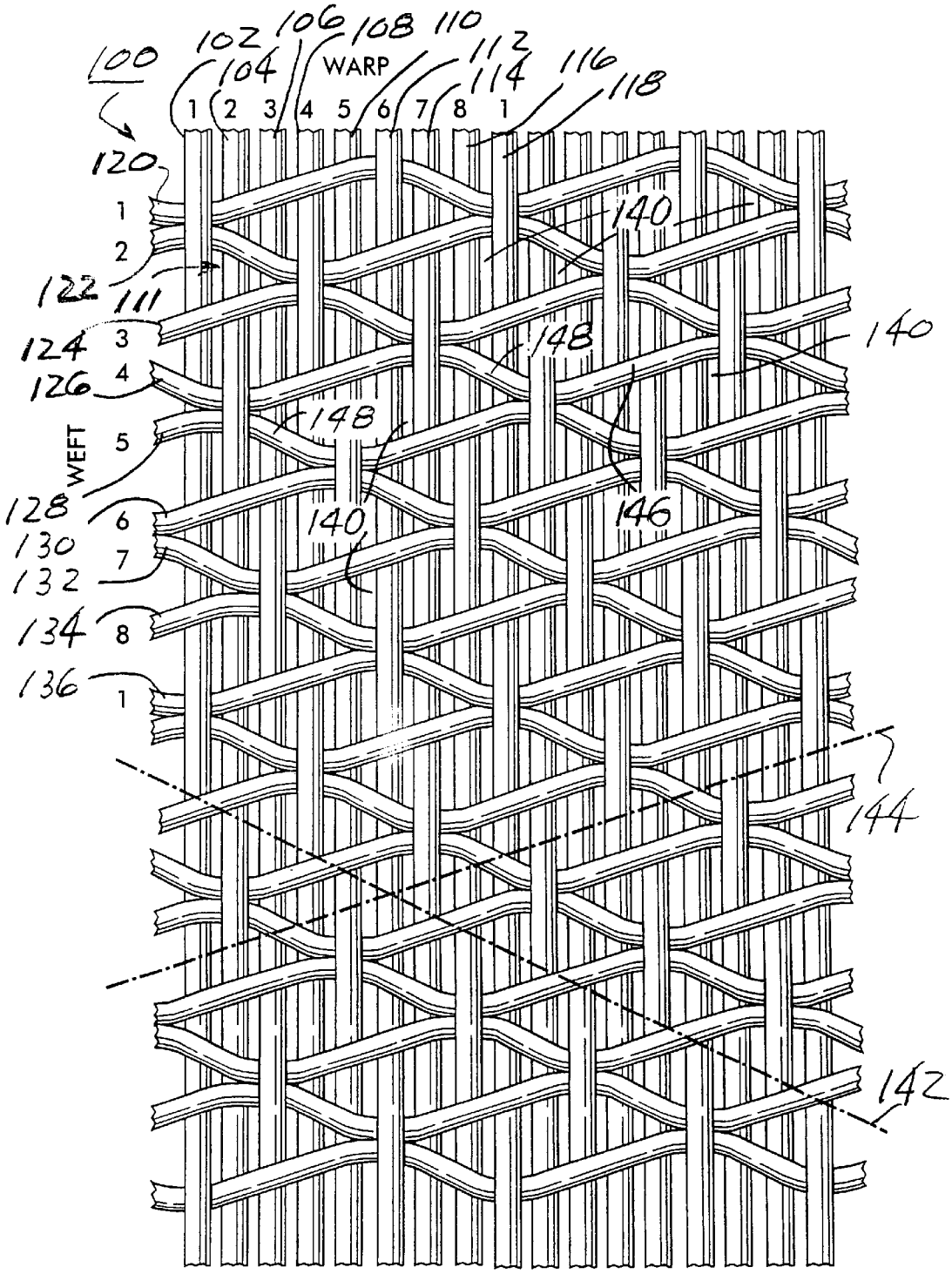
FIG. 6 is a view of one side of an alternative embodiment of a fabric of this invention, which is believed to be the preferred embodiment of the invention.
Figure 7:
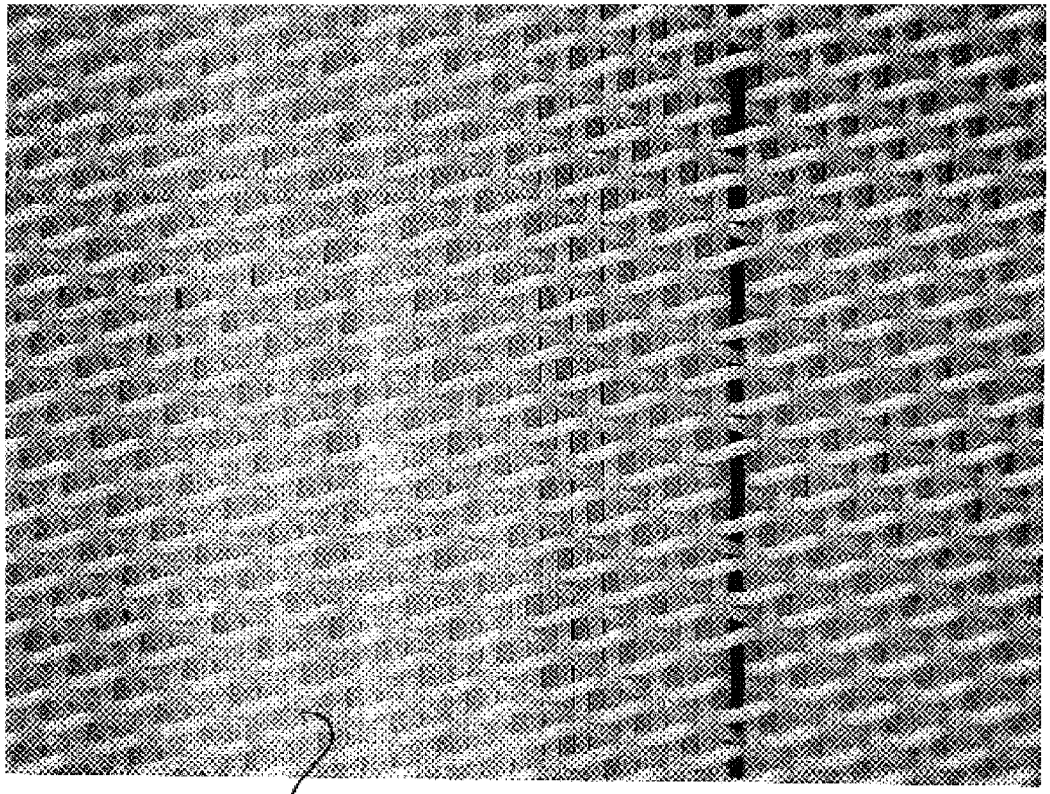
FIG. 7 is a photograph of the surface of the fabric illustrated in FIG. 6.

Referring to FIGS. 6 and 7, the web forming fabric 100, as viewed from side 111, is illustrated. This forming fabric includes systematically distributed high drainage areas 140 in both first substantially linear arrays, one of which is defined by reference line 142 passing generally through the center thereof and in second substantially linear arrays, one of which is defined by reference line 144 passing generally through the center thereof. Each of the systematically distributed high drainage areas 140 in each first array is separated from adjacent systematically distributed areas 140 in the same first array by angled segments, e.g., 146 of single transverse yarns, e.g., 124 and 126. Moreover, each of the systematically distributed areas 140 in each of the second substantially linear arrays defined by reference lines 144 is separated from adjacent systematically distributed areas in the same second array by angled segments, e.g., 148 of single transverse yarns, e.g., 126 and 128. This results in each of the boundaries between adjacent systematically distributed areas 140 being provided by a yarn segment of only a single yarn, which eliminates the heavy twill lines provided by the web forming fabric 10. This results in the regions of low drainage in the web forming fabric 100 being minimized relative to the web forming fabric 10 illustrated in FIGS. 1 and 3.

It is believed that the weave pattern included in the web forming fabric 100 may provide a more preferred construction than the weave pattern provided in the web forming fabric 10 by eliminating the heavy twill pattern formed by multiple, contiguous weft yarns. Such a heavy twill pattern can adversely effect the tensile strength properties of the fibrous webs formed on the fabric.

In particular, in the web forming fabric 10 illustrated in FIGS. 1 and 3, spaced-apart, heavy, angled twill lines are provided by multiple contiguous yarn segments located between the reference lines 64. These heavy, angled twill lines result in the formation of angled low basis weight regions in the formed web, thereby creating, for many applications, an undesirably low tensile strength. This same deficiency does not exist in the fabric 100.

Referring to FIGS. 8 and 9, it should be noted that in side 111*a* of the fabric 100 each of the machine direction yarns floats over six contiguous weft yarns in each repeat, e.g., warp yarn 102 floats continuously over weft yarns 124, 126, 128, 130,132 and 134; warp yarn 104 floats continuously over weft yarns 130, 132, 134, 136 (120), 122 and 124, etc. Moreover, each of the machine direction yarns in the side 111*a* floats continuously over three of the same weft yarns as each adjacent machine direction yarn, e.g., both machine direction yarns 102 and 104 float continuously over weft yarns 130, 132 and 134; both machine direction yarns 104 and 106 float continuously over weft yarns 120, 122 and 124, etc. Thus each continuous float of each machine direction yarn in the side 111*a* partially overlaps in the machine direction with a continuous float of an adjacent machine direction yarn over a distance equal to the three contiguous weft yarns over which each of said adjacent yarns floats.

Thus, the long machine direction floats in side 111*a* provided by each machine direction yarn, accompanied by the fact that the machine direction floats in adjacent machine direction yarns partially overlap in the machine direction, should provide excellent adherence of the web being formed to a Yankee dryer or other creping cylinder in the circumferential direction of creping from the dryer or cylinder. Thus the side 111*a* of the fabric 100 is believed to be well suited for use as the web contacting surface when the fabric 100 is employed in a through air dryer section and for then conveying the web dried in that section to the Yankee dryer or other cylinder for subsequent creping.

Without further elaboration, the foregoing will so fully illustrate my invention that others may, by applying current or future knowledge, readily adopt the same for use under various conditions of service.

We claim:

1. A web forming fabric having a machine direction of intended movement on a web forming machine and a cross-machine direction substantially normal to said machine direction, said fabric including machine direction yarns disposed generally in the machine direction and transverse yarns disposed generally transversely to the machine direction, said fabric including on one side thereof first and second substantially linear arrays of systematically distributed areas of high drainage, said first and second substantially linear arrays being oriented at an acute angle to the machine direction and at an acute angle to each other, the boundaries of each of said systematically distributed areas being defined by two pairs of adjacent sides, the adjacent sides of one pair being angled segments of one transversely extending yarn and the adjacent sides of the other pair being angled segments of a second transversely extending yarn contiguous to said one transversely extending yarn.

2. The web forming fabric of claim 1, wherein the systematically distributed areas of high drainage include only machine direction yarns within the boundaries thereof.

3. A web forming fabric having a machine direction of intended movement on a web forming machine and a cross-machine direction substantially normal to said machine direction, said fabric including machine direction yarns disposed generally in the machine direction and transverse yarns disposed generally transversely to the machine direction, said fabric including on one side thereof first and second substantially linear arrays of systematically distributed areas of high drainage, said first and second substantially linear arrays being oriented at an acute angle to the machine direction and at an acute angle to each other, each of said systematically distributed areas in said first substantially linear array being separated from an adjacent systematically distributed area in the same first substantially linear array by a boundary in the form of an angled segment of a single transverse yarn and each of said systematically distributed areas in said second substantially linear array being separated from an adjacent systematically distributed area in the same second substantially linear array by a boundary in the form of a plurality of contiguous angled segments of contiguous transverse yarns, said contiguous angled segments of contiguous transverse yarns providing areas of drainage lower than that of the systematically distributed areas.

4. The web forming fabric of claim 3, wherein each systematically distributed area in said first substantially linear array is separated from contiguous systematically distributed areas on opposite sides thereof and in said same first substantially linear array by spaced-apart angled segments of a pair of single transverse yarns that are contiguous to each other.

5. The web forming fabric of claim 3, wherein the systematically distributed areas of high drainage include only machine direction yarns within the boundaries thereof.

6. The web forming fabric of claim 4, wherein the systematically distributed areas of high drainage include only machine direction yarns within the boundaries thereof.

7. A web forming fabric having a machine direction of intended movement on a web forming machine and a cross-machine direction substantially normal to said machine direction, said fabric including machine direction yarns disposed generally in the machine direction and transverse yarns disposed generally transversely to the machine direction, said fabric including on one side thereof first and second substantially linear arrays of systematically distributed areas of high drainage, said first and second substantially linear arrays being oriented at an acute angle to the machine direction and at an acute angle to each other, each of said systematically distributed areas in said first substantially linear array being separated from an adjacent systematically distributed area in said same first substantially linear array by a boundary in the form of an angled segment of a single transverse yarn and each of said systematically distributed areas in said second substantially linear array being separated from an adjacent systematically distributed area in said same second substantially linear array by a boundary in the form of an angled segment of a single transverse yarn.

8. The web forming fabric of claim 7, wherein each systematically distributed area in said first substantially linear array is separated from contiguous systematically distributed areas on opposite sides thereof and in said same first substantially linear array by spaced-apart angled segments of a pair of single transverse yarns that are contiguous to each other.

9. The web forming fabric of claim 7, wherein the systematically distributed areas of high drainage include only machine direction yarns within the boundaries thereof.

10. The web forming fabric of claim 8, wherein the systematically distributed areas of high drainage include only machine direction yarns within the boundaries thereof.

11. The web forming fabric of claim 1, wherein each of the machine direction yarns on the side of the fabric opposed to the side including the systematically distributed surface areas include long floats over at least six adjacent transverse yarns and said long floats in adjacent machine direction yarns partially overlap each other in said machine direction.

12. The web forming fabric of claim 11, wherein said long floats in adjacent machine direction yarns partially overlap each other in said machine direction over a distance of at least three contiguous transverse yarns.

13. The web forming fabric of claim 11, wherein said long floats are over six adjacent transverse yarns.

14. The web forming fabric of claim 11, wherein said long floats are over seven adjacent transverse yarns.

15. The web forming fabric of claim 11, wherein said long floats are over six adjacent transverse yarns and said long floats of adjacent machine direction yarns overlap each other in the machine direction over a distance of three contiguous transverse yarns.

16. The web forming fabric of claim 11, wherein said long floats are over seven adjacent transverse yarns and said long floats of adjacent machine direction yarns overlap each other in the machine direction over a distance of four contiguous transverse yarns.

17. The web forming fabric of claim 3, wherein each of the machine direction yarns on the side of the fabric opposed to the side including the systematically distributed surface areas include long floats over seven adjacent transverse yarns and said long floats in adjacent machine direction yarns partially overlap each other in said machine direction.

18. The web forming fabric of claim 17, wherein said long floats of adjacent machine direction yarns overlap each other in the machine direction over a distance of four contiguous transverse yarns.

19. The web forming fabric of claim 7, wherein each of the machine direction yarns on the side of the fabric opposed to the side including the systematically distributed surface areas include long floats over six adjacent transverse yarns and said long floats in adjacent machine direction yarns partially overlap each other in said machine direction.

20. The web forming fabric of claim 19, wherein said long floats of adjacent machine direction yarns overlap each other in the machine direction over a distance of three contiguous transverse yarns.

* * * * *